United States Patent [19]

Haas et al.

[11] 4,182,133

[45] Jan. 8, 1980

[54] HUMIDITY CONTROL FOR A REFRIGERATION SYSTEM

[75] Inventors: Rudy E. Haas; Michael E. Smorol, both of Syracuse; Richmond S. Hayes, Fayetteville, all of N.Y.

[73] Assignee: Carrier Corporation, Syracuse, N.Y.

[21] Appl. No.: 930,258

[22] Filed: Aug. 2, 1978

[51] Int. Cl.[2] ..... F25D 17/06; F25B 13/00; F25D 17/04; F25B 1/00

[52] U.S. Cl. ..... 62/93; 62/160; 62/176 B; 62/228; 62/324; 62/504

[58] Field of Search ..... 62/93, 160, 176 B, 504, 62/228 B, 228 D, 324 A

[56] References Cited

U.S. PATENT DOCUMENTS

| | | | |
|---|---|---|---|
| 2,090,782 | 8/1937 | Carraway | 62/176 B |
| 2,162,860 | 6/1939 | Philipp | 62/93 |
| 2,222,236 | 11/1940 | Philipp | 62/93 |
| 2,222,237 | 11/1940 | Philipp | 62/93 |
| 2,222,239 | 11/1940 | Philipp | 62/93 |
| 2,222,240 | 11/1940 | Philipp | 62/93 |
| 2,614,394 | 10/1952 | McGrath | 62/93 |
| 2,761,615 | 9/1956 | Prince | 62/160 X |
| 2,992,541 | 7/1961 | Sutton | 62/160 X |
| 3,449,922 | 6/1969 | Ruff et al. | 62/160 |
| 3,545,219 | 12/1970 | Falk | 62/160 |

*Primary Examiner*—Lloyd L. King

*Attorney, Agent, or Firm*—J. Raymond Curtin; Robert P. Hayter

[57] ABSTRACT

Apparatus and a method for controlling refrigerant flow through the indoor coil of air conditioning equipment including a refrigeration system such that upon predetermined humidity conditions being sensed refrigerant flow will be routed to provide additional latent cooling and dehumidification. Within the liquid header of the indoor coil in the refrigeration system a solenoid valve is mounted to isolate at least one of a plurality of refrigerant circuits. This valve is closed when a need for dehumidification is detected by a humidistat located in communication with the air of the enclosure to be conditioned. When a need for dehumidification is not detected by the humidistat the valve is opened and refrigerant flows through all of the circuits of the indoor coil. Additionally, a check valve is mounted in parallel with the solenoid valve such that if a reversible refrigeration system is utilized refrigerant flow can bypass the solenoid valve in the heating mode of operation.

14 Claims, 2 Drawing Figures

HUMIDITY CONTROL FOR A REFRIGERATION SYSTEM

BACKGROUND OF THE INVENTION

1. Field of the Invention

This invention relates to air conditioning systems employing refrigeration units and in particular to such a system having improved dehumidification capabilities. This system is particularly adaptable to heat pumps and refrigeration systems wherein latent head cooling is controlled by regulating the temperature of the indoor coil in communication with the air to be conditioned.

2. Prior Art

It has been recognized in many geographical areas that proper air conditioning systems should not only lower the temperature of the space being served when the temperature therein has exceeded a predetermined level but should also decrease the relative humidity of the space as a function of the air conditioning. During the typical air conditioning operation air from the enclosure to be conditioned is circulated over a heat exchanger. The exchanger absorbs heat from the air lowering its dry bulb temperature. If the temperature of the air is lowered beneath its dew point, then moisture from the air is condensed onto the heat exchanger surfaces and the actual amount of moisture contained in the air is reduced. Should the air to be cooled not be lowered beneath the dew point, then no water will be removed from the air and there will be no dehumidification effect. In fact it is possible to increase the relative humidity of air being conditioned since if moisture is not removed from the air then when the dry bulb temperature is decreased the capability of the air to absorb moisture is also decreased and the ratio between the actual moisture contained in the air and the amount of moisture that may be contained within the air is increased. Consequently, relative humidity can increase during the air conditioning process.

To provide for additional latent cooling it is necessary to lower the temperature of the heat exchanger such that the air passing through the heat exchanger will be lowered in temperature below the dew point and moisture will be removed therefrom. The conventional way of reducing the temperature of the heat exchanger has been by varying the flow of air over the heat exchanger surface. A reduction in flow rate allows the temperature of the coil to decrease and consequently additional moisture may be removed from the air. Typical of this type of air volume control for improved dehumidification is U.S. Pat. No. 4,003,729.

The described apparatus and method herein utilize another method of lowering the temperature of the coil through which the air is passed. The indoor coil or evaporator has multiple refrigerant flow circuits. When the unit is in the cooling mode of operation and additional dehumidification is desired, one or more of the circuits are isolated from the remainder of the coil such that all of the refrigerant flow is directed through the remaining circuits. The effect of additional refrigerant flow through the remaining circuits and the same volume of air flow being in contact with those circuits is to lower the temperature of that portion of the heat exchanger because of the lowering of the suction temperature through which refrigerant is flowing and consequently to increase the amount of moisture removed from the air. The dehumidified and cooled air passing thru that portion of the coil where there is refrigerant flow is then mixed with the unconditioned air passing through the remainder of the coil prior to delivery to the enclosure being conditioned.

The apparatus and method described herein further provide for controlling the humidity level by utilization of a humidistat in communication with the air of the enclosure to be conditioned. Upon the humidistat sensing a humidity level within a predetermined range a valve mechanism is regulated to limit the number of flow circuits available for the refrigerant.

Through experimentation it has been discovered that most humans are comfortable when the temperature humidity index is less than 70. Once the temperature humidity index level reaches 75 approximately half the population is uncomfortable and at a level of 80 most of the population is uncomfortable. The temperature humidity index level is determined by multiplying the sum of the wet bulb and dry bulb temperatures by a factor of 0.4 and adding 15. It is the purpose of the present invention to decrease the dry bulb temperature through the normal air conditioning process and to decrease the wet bulb temperature such that a combination of these two factors maintains the temperature humidity index level within the comfort range. The utilization of a solenoid valve to limit refrigerant flow through part of the indoor coil provides for an additional reduction in wet bulb temperature which will allow the air in the enclosure to be maintained closer to the comfortable regions. Since a thermostat senses only dry bulb temperature an additional device such as a humidistat is necessary to evaluate the moisture content of the air.

SUMMARY OF THE INVENTION

It is an object of this invention to provide an air conditioning system having improved dehumidification capabilities.

It is a further object of this invention to monitor the humidity level of the air of the enclosure to be conditioned to maintain a desired comfort range.

It is a yet further object of this invention to provide both dry bulb and wet bulb temperature control over an area to be conditioned.

It is another object of the present invention to provide apparatus for use in reversible refrigeration systems such that in the heating mode of operation there will be no restrictions to refrigerant flow and in the cooling mode of operation the number of circuits utilized to effect the appropriate dehumidification conditions may be selected.

It is a still further object of the present invention to provide a safe, economical and reliable system of maintaining a given humidity and temperature level within an enclosure.

These and other objects of the present invention are attained in an air conditioning system employing a refrigeration unit having a compressor, outdoor coil, expansion means, and indoor coil. The indoor coil has associated therewith a liquid header for supplying refrigerant from the expansion means to multiple circuits within the coil and a gas header for receiving the gaseous refrigerant from the coil and conducting same back to the compressor. A solenoid valve is mounted in the liquid header between the connections to the various circuits of the indoor coil such that refrigerant flow may be prevented to one or more of said circuits when the valve is in the closed position. A humidistat mounted in communication with the air in the enclosure is utilized to control the solenoid valve such that when a humidity level above the predetermined amount is detected the valve is closed limiting the number of available circuits for refrigerant flow. A check valve is mounted in parallel with the solenoid valve such that when the refrigeration system is operated in a reverse mode for providing heat to the enclosure, the refrigerant will simply bypass the solenoid valve. Electrical controls are provided such that the solenoid valve may be only closed when the unit is in the cooling mode of operation and such that during defrost, the solenoid valve will remain open. If a multiple compressor speed unit is utilized then the solenoid valve can be controlled to open only during the high speed mode of operation. A humidistat is mounted in communication with the air of the enclosure and the various electric components to control solenoid valve operation.

DESCRIPTION OF THE PREFERRED EMBODIMENT

The embodiment described hereafter having a solenoid valve and a check valve is disclosed within a reversible refrigeration system known as a heat pump. It is understood that use of a solenoid valve for regulating the number of refrigerant circuits having refrigerant flowing therethrough for humidity control is equally applicable to refrigeration systems which supply only cooling to an enclosure.

Figure 1:
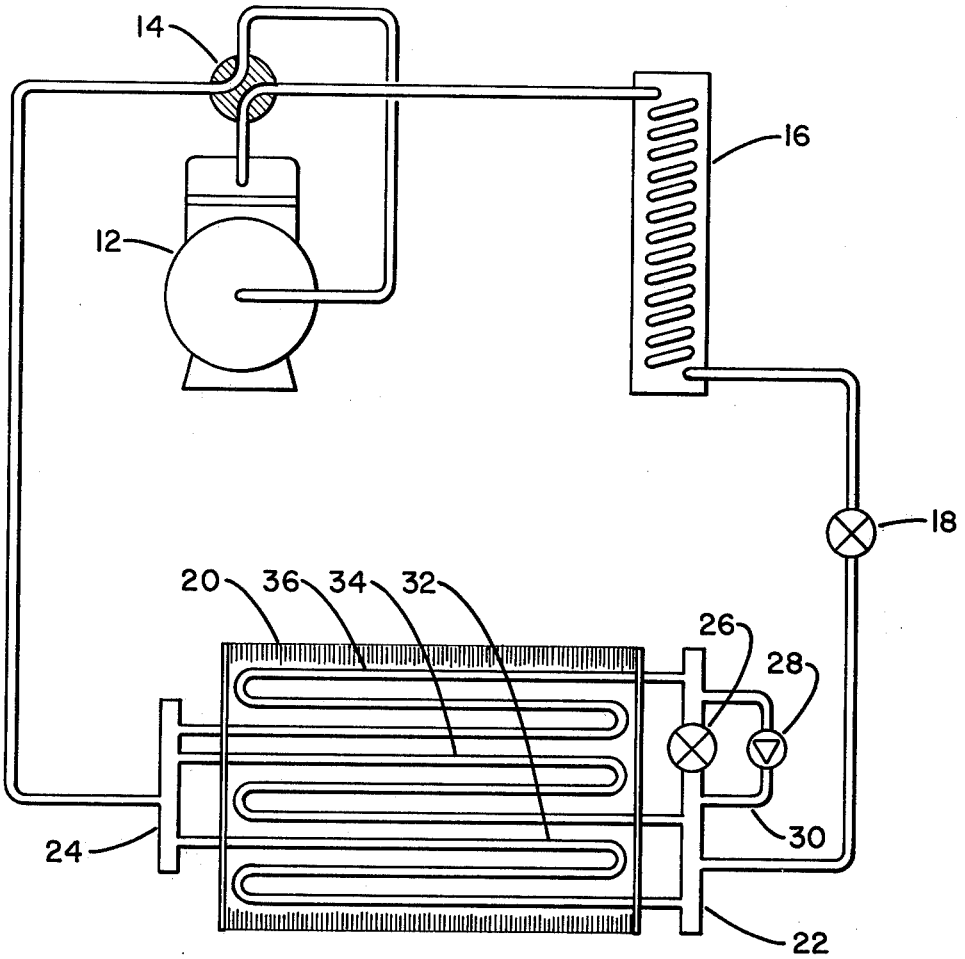
FIG. 1 is a schematic illustration of a reversible refrigeration unit of the type employed in an air conditioning system.

Referring now to the drawings it can be seen in FIG. 1 that compressor 12 is connected through a reversing valve 14 to outdoor coil 16 and indoor coil 20. Mounted between outdoor coil 16 and indoor coil 20 is multidirection expansion valve 18 which may be any expansion device as are well-known in the art. Liquid header 22 is shown connecting the expansion valve to the three circuits shown for indoor coil 20. The first indoor coil circuit 32, second indoor coil circuit 34 and third indoor coil circuit 36 are all connected between liquid header 22 and gas header 24 such that refrigerant may flow between the headers through the coil. The number and location of the individual circuits is a matter of design hoice.

Solenoid valve 26 is mounted within liquid header 22. Solenoid valve 26 is located such that when it is in the closed position refrigerant flow from the liquid header 22 will be directed only through the first indoor coil circuit 32 and the second indoor coil circuit 34. The third indoor coil circuit 36 will not receive any refrigerant flow when the solenoid valve is in the closed position.

Check valve 28 is mounted in bypass line 30 in parallel with solenoid valve 26. When the unit is operated in the heating mode of operation gaseous refrigerant is supplied to gas header 24 and then proceeds through all three indoor coil circuits where it is condensed to a liquid and then through liquid header 22 to expansion means 18. The refrigerant flowing through the third indoor coil circuit 36 in the heating mode bypasses solenoid valve 26 and travels through check valve 28 and bypass line 30 such that the refrigerant flow is not impeded by solenoid valve 26 in the heating mode of operation.

In the cooling mode of operation gaseous refrigerant from compressor 12 is circulated through the reversing valve to the outdoor coil 16 where it is condensed to a liquid. This liquid then undergoes a pressure drop at expansion valve 18 and a mixture of liquid and gas is then conducted through indoor coil 20 where it changes state from a liquid to a gas absorbing heat from the air passing over the coil. Once the refrigerant is changed from a liquid to a gas absorbing heat from the air to be conditioned, the gas is then collected in header 24 and returned to compressor 12 through reversing valve 14.

For a given system there is a selected amount of refrigerant flow and based upon the heat transfer relationship between the indoor coil 20 and the air passing thereover including the volume flow rate of the air, its temperature and other conditions such that there is a temperature established for the indoor coil. At that temperature a specific amount of water may or may not be removed from the air passing over the indoor coil depending upon the dew point temperature of the air as compared to the coil temperature. When an additional dehumidification need is sensed by the humidistat, solenoid valve 26 operates to prevent refrigerant flow through the third indoor circuit and consequently there is increased refrigerant flow through each of the first and second circuits. This increase in flow in a given heat transfer area provides for a lower coil temperature in the portions of the coil served by the first and second circuits and consequently additional moisture removal since the amount of moisture that may be contained in air is a function of its temperature. The temperature of the air in contact with the first and second circuits is lower when the solenoid valve is closed and refrigerant flow is limited to the first two circuits than when the valve is open and refrigerant flow is through all of the circuits. As a result of the refrigerant routing more moisture will be removed from the air and the wet bulb temperature will be decreased.

Figure 2:
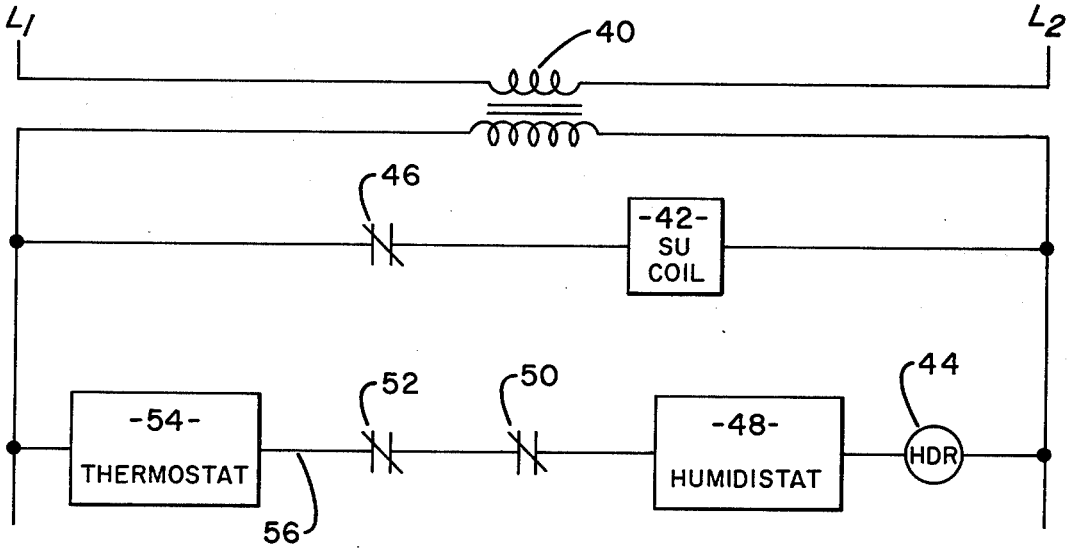
FIG. 2 is simplified wiring diagram showing the controls for the solenoid valve of the system.

Referring to FIG. 2 it can be seen the power is supplied through lines L1 and L2 to transformer 40. Control power typically at 24 volts is then supplied through the secondary winding of the transformer through normally closed humidistat relay contacts 46 to the solenoid valve coil 42. Consequently the solenoid valve coil is energized and the valve is open allowing refrigerant to flow through all three circuits whenever current is supplied to the transformer and the humidistat relay controlling the humidistat relay contacts 46 is not energized. Thermostat 54 is shown receiving power from transformer 40. Wire 56 leaving thermostat 54 is connected such that it is energized when the thermostat detects a cooling need. Additional wires obviously are necessary for commencing compressor operation, defrost and other modes of operation including heating, however, these are not shown since they are not specifically involved with the invention as claimed herein. Once the thermostat detects a cooling need wire 56 is energized and current is conducted thru normally closed low speed relay contacts 52 and normally closed defrost thermostat relay contacts 50 to humidistat 48. Humidistat 48 senses the humidity level of the air in the enclosure to be conditioned. When the humidity level rises to an undesirable level internal contacts within the humidistat close supplying power to energize humidistat relay 44. Once humidistat relay 44 is energized normally closed humidistat relay contacts 46 are opened and the solenoid coil is deenergized such that the solenoid valve closes limiting refrigerant flow to the first two coil circuits.

The low speed relay normally closed contacts 52 are shown to indicate that if this were a multiple compressor speed system that at high speed operation the humidistat would not be energized and consequently refrigerant flow would be through all three circuits. This assures that normal operation at high speed provides for sufficient dehumidification. However to obtain dehumidification at low speed with the same heat exchanger a portion of that heat exchanger can be segregated with a solenoid valve as herein.

The normally closed defrost thermostat relay contacts 50 are also shown to indicate that if the unit is operated in the defrost mode then the humidistat will be deenergized such that the solenoid valve will be open. This relay acts to assure that the solenoid valve will be in the open position if the unit is in the defrost mode of operation. Humidistat 48 is a conventional humidity sensing device mounted in the enclosure to be served such that upon the detection of a given humidity level its contacts close and energize humidistat relay 44.

The foregoing description has described a reversible air conditioning system having an indoor coil with three circuits. It is to be understood that this invention has like applicability to a nonreversible cooling system and to indoor coils with different circuiting arrangements. Only a partial schematic of the wiring diagram of the unit has been shown. This diagram is believed sufficient to indicate the humidistat operation in combination with the solenoid valve. Modifications and variations of the invention as described should be apparent to those skilled in the art and are within the spirit and scope of the invention.

What is claimed is:

1. A refrigeration system having a multiple speed compressor, a condenser and expansion means which comprises:

a multiple circuit evaporator;

distribution means connected to route refrigerant to the various circuits of the evaporator;

a valve means mounted in the distribution means to isolate at least one evaporator circuit from the remaining circuits such that refrigerant flow may be interrupted to at least one circuit of the evaporator; and control means for regulating the valve means dependent upon the compressor speed.

2. The apparatus as set forth in claim 1 wherein the distribution means is a header and wherein the valve means is a solenoid valve mounted within the header and the control means comprises a humidistat located in the enclosure to be conditioned to sense the humidity level of the air in the enclosure.

3. The apparatus as set forth in claim 2 wherein upon the humidistat sensing a predetermined humidity level the solenoid valve is actuated to limit refrigerant flow to a selected number of the circuits of the evaporator thereby providing for additional latent cooling and moisture removal from the air passing through the evaporator.

4. A reversible refrigeration system having a multispeed compressor, an outdoor heat exchanger, reversing means and expansion means which comprises:

a multiple circuit indoor heat exchanger;

a first header connected to route refrigerant to each indoor heat exchanger circuit in the cooling mode of operation and to receive refrigerant from each circuit during the heating mode of operation;

a second header connected to receive refrigerant from each indoor heat exchanger circuit in the cooling mode of operation and supply refrigerant to each circuit during the heating mode of operation;

valve means mounted in at least one header to isolate at least one indoor heat exchanger circuit from the remaining circuits such that in the cooling mode of operation refrigerant flow may be interrupted to at least a portion of the indoor heat exchanger; and control means for regulating the valve means dependent upon the speed of operation of the compressor.

5. The apparatus as set forth in claim 4 and further including:

bypass means mounted in parallel with the valve means, said bypass means acting to prevent refrigerant flow through the bypass means in the cooling mode of operation and operating to allow flow through the bypass means in the heating mode of operation.

6. The apparatus as set forth in claim 5 wherein the valve means is a solenoid valve mounted in at least one header associated with the indoor heat exchanger such that upon the valve being energized, refrigerant may flow through the valve and upon the valve being deenergized refrigerant flow is discontinued through the valve to at least one circuit of the indoor heat exchanger.

7. The apparatus as set forth in claim 6 wherein the bypass means comprises a check valve.

8. The apparatus as set forth in claim 5 wherein the control means includes a humidistat mounted in communication with the air in the enclosure to be conditioned sch that the humidity level of said air may be sensed.

9. The apparatus as set forth in claim 6 and further including a first relay having normally closed contacts for controlling operation of the soenoid valve; and second relay contacts connected such that the solenoid valve is deenergized by the first relay contacts being opened when the system is operated in the defrost mode of operation.

10. The apparatus as set forth in claim 5 wherein the reversible refrigeration system is capable of multiple compressor speed operation and the valve means may only be operated when the unit is in a preselected speed of operation.

11. A method of regulating refrigerant flow through a multiple circuit evaporator of a refrigeration system having a condenser, a multiple speed compressor and expansion apparatus which comprises the steps of:

routing the refrigerant through all of the circuits of the indoor heat exchanger when cooling is required;

sensing the humidity level of the enclosure to be conditioned;

limiting refrigerant flow to a preselected number of the circuits of the indoor heat exchanger when the humidity level is within a predetermined range such that additional latent heat cooling is provided when the compressor is operatin at less than full speed.

12. A method of regulating refrigerant flow through a multiple circuit indoor heat exchanger of a multiple speed compressor reversible refrigeration system having an outdoor heat exchanger, a multiple speed compressor, and expansion apparatus which comprises the steps of:

routing the refrigerant through all of the circuits of the indoor heat exchanger when the system is in the heating mode of operation;

selecting the appropriate speed of compressor operation when the system is in the cooling mode of operation;

routing the refrigerant through all of the indoor heat exchanger circuits when the unit is operated in the defrost mode of operation or at low compressor speed in the cooling mode of operation;

sensing the humidity level of the enclosure to be conditioned;

conducting the refrigerant through all of the indoor heat exchanger circuits when the unit is operated at high speed in the cooling mode of operation and the humidity level is within a predetermined range; and preventing refrigerant flow through a portion of the indoor heat exchanger in the cooling mode of operation when the unit is operated at low speed and the humidity level is not within a predetermined range.

13. The method as set forth in claim 12 wherein the step of preventing includes utilizing a solenoid valve to prevent refrigerant flow into at least one circuit of the indoor heat exchanger.

14. The method as set forth in claim 13 wherein the step of preventing additionally includes valve means in parallel with said solenoid valve such that when the unit is operated in the heating mode of operation the solenoid valve is bypassed.

* * * * *